US005728655A

United States Patent [19]

Muraki et al.

[11] Patent Number: 5,728,655

[45] Date of Patent: Mar. 17, 1998

[54] REFRIGERATING MACHINE OIL COMPOSITION FOR USE WITH HCFC AND HFC REFRIGERANTS

[75] Inventors: Masayoshi Muraki; Yukiharu Beppu; Shozaburo Konishi, all of Kanagawa; Takayoshi Hamada, Aichi; Nobuo Murata, Aichi; Norimasa Nishiura, Aichi, all of Japan

[73] Assignees: Mitsubishi Oil Company, Limited; Mitsubishi Jukogyo Kabushiki Kaisha, both of Tokyo, Japan

[21] Appl. No.: 588,701

[22] Filed: Jan. 19, 1996

[30] Foreign Application Priority Data

Jan. 27, 1995 [JP] Japan ..... 7-031663

[51] Int. Cl.[6] ..... C10M 105/38; C10M 129/18

[52] U.S. Cl. ..... 508/304; 508/433; 508/438; 252/68

[58] Field of Search ..... 252/565, 49.8, 252/45, 46.6, 49.3, 49.5, 32.7 R, 32.7 E, 32.7 HC, 68; 508/304, 433, 438

[56] References Cited

U.S. PATENT DOCUMENTS 5,021,179 6/1991 Zehler et al. ..... 252/68

5,185,092 2/1993 Fukuda et al. ..... 252/68

5,447,647 9/1995 Ishida et al. ..... 252/68

5,620,950 4/1997 Kamakura et al. ..... 252/68

*Primary Examiner*—Alan Diamond

*Attorney, Agent, or Firm*—Sughrue, Mion, Zinn, Macpeak & Seas, PLLC

[57] ABSTRACT

A refrigerating machine oil composition for vapor compression type refrigerating machines is disclosed which can be used with either of HCFC refrigerants and HFC refrigerants. The inventive machine oil composition comprises a polyol ester (ester compound) as a base oil. Furthermore, the base oil contains from 1.0 to less than 5.0% by weight of a phosphate, from 0.1 to 2.0% by weight of an alkyl phosphorothionate and/or an aryl phosphorothionate, and from 0.05 to 2.0% by weight of an epoxy compound. The composition is free from sludge formation and insufficient lubricity, which are drawbacks of the polyol ester, due to the synergistic effect of these additives. On the other hand, the inventive composition provides the desirable properties of a polyol ester base oil, namely, good compatibility with refrigerants, high electrical insulating properties, and low hygroscopicity.

5 Claims, 2 Drawing Sheets

REFRIGERATING MACHINE OIL COMPOSITION FOR USE WITH HCFC AND HFC REFRIGERANTS

FIELD OF THE INVENTION

The present invention relates to a refrigerating machine oil composition that can be used with either of a hydrochlorofluorocarbon (HCFC) refrigerant and a hydrofluorocarbon (HFC) refrigerant.

More particularly, this invention relates to a refrigerating machine oil composition for use in a vapor compression type refrigerating machine employing a hydrochlorofluorocarbon or a hydrofluorocarbon as a refrigerant. The inventive refrigerating machine oil exhibits excellent wear resistance, load carrying capacity, thermal and chemical stability, low-temperature fluidity and excellent refrigerant compatibility.

BACKGROUND OF THE INVENTION

1. General Performance Requirements of a Refrigerating Machine Oil

The important general performance requirements of a refrigerating machine oil are its wear resistance, load carrying capacity, thermal and chemical stability, low-temperature fluidity, and refrigerant compatibility.

Refrigerating machine oils are used to lubricate and cool sliding parts of a compressor, to radiate refrigerant compression heat, to seal the compressor in the refrigerant compression step, and to remove wear particles and foreign matters which wear the components, etc.

In view of the above requirements, refrigerating machine oils must not only provide excellent lubricating performance including wear resistance and load carrying capacity, but must also have high thermal and chemical stability in the presence of both the refrigerant and compressor materials such as electrical insulators and metal components so that the machine oil does not adversely affect these materials.

In a refrigerating machine, a part of the refrigerating machine oil enters the compressed refrigerant gas side and circulates through the refrigerating system to flow into the low-temperature side including an evaporator, capillary tubes and expansion valves.

Refrigerating machine oils must therefore have low-temperature fluidity and must be compatible with the refrigerant so as to enhance the cooling ability of the evaporator, improve oil return from the low-temperature side to the compressor, and attain sufficient lubrication of the sliding parts of the compressor when restarting the compressor at low temperatures.

2. Relationship Between the Refrigerant and the Refrigerating Machine Oil

Chlorofluorocarbons (CFC) and hydrochlorofluorocarbons (HCFC) refrigerants have conventionally been employed either alone or in combination in vapor compression type refrigerating machines.

Because of their low polarity, CFC and HCFC refrigerants are generally compatible with nonpolar hydrocarbon oils. That is, CFC and HCFC refrigerant molecules contain one or more chlorine atoms which react at the sliding surfaces of the compressor to yield a chloride which serves as a lubricant. In addition, hydrocarbon oils show satisfactory lubricity.

The refrigerating machine oils that are used in refrigerating machines which employ such CFC and HCFC refrigerants generally comprise a base oil (hydrocarbon oil) consisting of a properly refined naphthenic mineral oil, paraffinic mineral oil, alkylbenzene, poly-α-olefine, or the like or a mixture of two or more thereof, and additives such as an antioxidant, an anti-wear agent and a corrosion inhibitor.

A phosphate, which has low solubility in hydrocarbon oils and which shows a wear resistance effect at a low concentration, is added to hydrocarbon base oils usually in an amount of up to 1% by weight.

After publication of the hypothesis that the ozone layer in the stratosphere is being destroyed by CFC and HCFC refrigerants, international regulations were framed to control these refrigerants and preserve the global environment. Also, attempts have been made to develop refrigerant substitutes (new refrigerants). An international agreement prohibits the production of CFC refrigerants after 1996, and the production of HCFC refrigerants will be entirely prohibited after 2020.

A representative HCFC refrigerant is HCFC-22 (R-22). Possible substitutes for HCFC-22 refrigerant are hydrofluorocarbons (HFC), such as HFC-134a, HFC-143a, HFC-125, HFC-32, etc. and mixtures thereof.

Each of these HFC refrigerants are strongly polar and therefore have poor compatibility with hydrocarbon oils. Investigators are therefore seeking to develop a refrigerating machine oil suitable for use with HFC refrigerants.

3. Prior-Art Refrigerating Machine Oils for Use with HFC Refrigerants

Oxygenic synthetic hydrocarbon oils compatible with HFC refrigerants, such as, e.g., ester type synthetic oils and polyether type synthetic oils, are being considered as refrigerating machine oils for use in refrigerating machines employing an HFC refrigerant. The ester type synthetic oils are advantageous in that they have higher electrical insulating properties, better high-temperature compatibility, and lower hygroscopicity than polyether type synthetic oils.

Refrigerating machine oils based on an ester type synthetic oil are disclosed, e.g., in JP-A-56-133241 (the term "JP-A" as used herein means an unexamined published Japanese patent application") and JP-A-59-164393, and a refrigerating machine oil of the above kind especially for use with chlorofluorohydrocarbon or fluorohydrocarbon refrigerants is disclosed in JP-A-2-276894. Furthermore, refrigerating machine oils of the above kind especially for use with hydrofluorocarbon refrigerants are disclosed, e.g., in JP-A-3-88892, JP-A-3-128991 and JP-A-3-128992.

Refrigerating machine oils comprising an ester type synthetic oil and having incorporated therein a phosphate or a phosphite are disclosed in JP-A-55-92799, JP-A-56-36570, JP-A-56-125494, JP-A-62-156198, JP-A-3-24197 and JP-A-5-59388, and a refrigerating machine oil of the above kind for use as a heat pump oil is disclosed in JP-B-57-43593 (the term "JP-B" as used herein means an "examined Japanese patent publication").

Of the refrigerating machine oils described above, the refrigerating machine oil composition disclosed in JP-A-5-59388, whose corresponding U.S. patent application was matured into a patent as U.S. Pat. No. 5,342,533, is intended for use in refrigerating machines employing an HFC refrigerant. This machine oil consists essentially of a dibasic acid diester or a carboxylate of a polyhydric alcohol as a base oil, and a phosphate or a phosphite added to the base oil in an amount of from 5.0 to 90.0% by weight. JP-A-5-59388 (U.S. Pat. No. 5,342,533) discloses that if the addition amount of the phosphate or phosphite is less than 5.0% by weight, the effects of inhibiting sludge formation and improving wear resistance are insufficient.

Furthermore, JP-A-5-17792 discloses a refrigerating machine oil composition comprising an ester oil, an alkylbenzene or a mineral oil as a base oil and, incorporated therein, either an alkylene glycol diglycidyl ester or an aliphatic cyclic epoxy compound having a specific structure.

A refrigerating machine oil should have a particular structure suitable for the refrigerant used therewith. Refrigerating machine oils for use with CFC and HCFC refrigerants are difficult to use in refrigerating machines employing an HFC refrigerant, which is a new type of refrigerant. For example, ester type synthetic oils generate a sludge when used with an HCFC refrigerant, although they have excellent compatibility with HFC refrigerants.

Consequently, all of the prior-art refrigerating machine oils based on an ester type synthetic oil are intended for use in refrigerating machines employing an HFC refrigerant, and are unsuitable for use in refrigerating machines employing an HCFC refrigerant.

Since the production of HCFC refrigerants is restricted in stages and will be entirely prohibited after 2020, refrigerating machines employing an HCFC refrigerant necessitate not only replacement of the HCFC refrigerant used therein with an HFC refrigerant, but also replacement of the refrigerating machine oil with an oil suitable for the HFC refrigerant. If replacement of the refrigerating machine oil at the time of refrigerant replacement is not needed in refrigerating machines already in practical use, then maintenance of such refrigerating machines is made easy.

SUMMARY OF THE INVENTION

An object of the present invention is to provide a refrigerating machine oil composition which comprises a polyol ester (ester type synthetic oil) as a base oil and which is suitable for use with either of HCFC refrigerants and HFC refrigerants.

The object of the present invention is entirely contrary to conventional approaches. To attain this objective, the following characteristics are desired.

(i) Suitability for Use with HCFC Refrigerants

Because HCFC refrigerants contain one or more chlorine atoms in a molecule thereof, a polyol ester is susceptible to pyrolysis by the action of chlorine atoms. This pyrolysis decomposes extreme pressure additives, thereby leading to sludge formation.

In order to use a polyol ester with HCFC refrigerants, appropriate additives should be selected to inhibit sludge formation.

(ii) Suitability for Use with HFC Refrigerants

Because HFC refrigerants unlike HCFC refrigerants do not contain a chlorine atom in a molecule thereof, these refrigerants do not yield a chloride which serves as a lubricant. Furthermore, polyol esters have inferior lubricity as compared to hydrocarbon oils.

In addition, polyol esters tend to generate sludge within the heated compressor, because these compounds are chemically more active than hydrocarbon oils.

To use a polyol ester with HFC refrigerants, appropriate additives should be selected to compensate for insufficient lubricity and to inhibit sludge formation during high-temperature operation.

To achieve the above-described characteristics and thereby attain the object of this invention, the present inventors investigated many kinds of additives so as to select those that are suitable for polyol esters. As a result, the present inventors found that even when the amount of a phosphate added to a polyol ester is less than 5.0% by weight, lubricity can be improved and sludge formation can be inhibited by further incorporating specific additives in optimum proportions. The present invention has been completed based on this finding.

The present invention provides a refrigerating machine oil composition for use in a vapor compressor employing a hydrochlorofluorocarbon or hydrofluorocarbon as a refrigerant.

More particularly, the above objectives of the present invention have been achieved by providing a refrigerating machine oil comprising a polyol ester as a base oil, said base oil containing (a) a phosphate in an amount of from 1.0 to less than 5.0% by weight, (b) at least one of an alkyl phosphorothionate and an aryl phosphorothionate in an amount of from 0.1 to 2.0% by weight, and (c) an epoxy compound in an amount of from 0.05 to 2.0% by weight, wherein the amounts of ingredients (a), (b), and (c) each is based on the amount of said base oil.

DETAILED DESCRIPTION OF THE INVENTION

1. Base Oil

Figure 1:
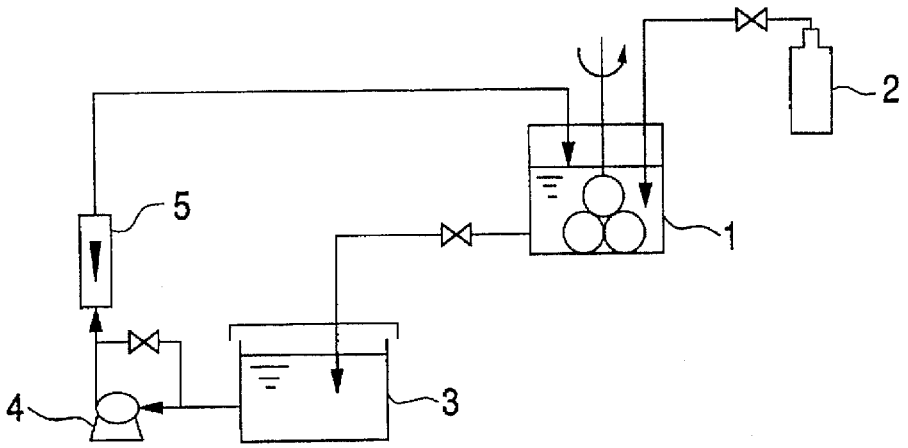
FIG. 1 is a diagrammatic view of an apparatus for measuring friction torque using a four-ball tester.

A polyol ester is used as a base oil in the present invention.

The polyol esters which can be used in this invention are those obtained by reacting at least one polyhydric alcohol with a carboxylic acid (e.g., a linear saturated fatty acid, a fatty acid having one alkyl branch, or a fatty acid having two or more alkyl branches), mixtures of these esters, and esters obtained by reacting a mixture of a polyhydric alcohol and at least one carboxylic acid.

Examples of the polyhydric alcohol include neopentyl glycol, trimethylolpropane, pentaerythritol and dipentaerythritol.

Examples of the linear saturated fatty acid include acetic acid, propanoic acid, butanoic acid, pentanoic acid, hexanoic acid, heptanoic acid, octanoic acid, nonanoic acid, decanoic acid, undecanoic acid and dodecanoic acid.

Examples of the fatty acid having one alkyl branch include isobutanoic acid, 2-methylbutanoic acid, isopentanoic acid, trimethylpropanoic acid, 2-methylpentanoic acid, 3-methylpentanoic acid, 4-isocaproic acid, 8-ethylhexanoic acid, 4-propylpentanoic acid, 4-ethylpentanoic acid, 2-methyldecanoic acid, 3-methyldecanoic acid, 4-methyldecanoic acid, 5-methyldecanoic acid, 6-methyldecanoic acid, 6-ethylnonanoic acid, 5-propyloctanoic acid, 3-methylundecanoic acid and 6-propylnonanoic acid.

Examples of the fatty acid having two or more alkyl branches include 2,2-dimethylbutanoic acid, 2,2-dimethylpentanoic acid, 2,2,3-trimethylbutanoic acid, 2,2-dimethylhexanoic acid, 2-methyl-3-ethylpentanoic acid, 2,2,3-trimethylpentanoic acid, 2,2-dimethylheptanoic acid, 2-methyl-3-ethylhexanoic acid, 2,2,4-trimethylhexanoic acid, 2,2-dimethyl-3-ethylpentanoic acid, 2,2,3-trimethylpentanoic acid, 2,2-dimethyloctanoic acid, 2-butyl-5-methylpentanoic acid, 2-isobutyl-5-methylpentanoic acid, 2,3-dimethylnonanoic acid, 4,8-dimethylnonanoic acid and 2-butyl-5-methylhexanoic acid.

The polyol ester generally has a viscosity of from 5 to 150 $mm^2/s$ (40° C.), and can have an acid value of up to 1 mgKOH/g and a water content of up to 500 ppm. The polyol ester preferably has an acid value of 0.01 mgKOH/g or lower and a water content of 100 ppm or lower. These characteristics may be obtained by subjecting the ester to distillation, filtration, and treatment with an adsorbent and a dehydrating agent to remove impurities, contaminants, and water which influence thermal stability.

2. Additives (1) Phosphate

The phosphate which can be used in this invention is an ester of phosphoric acid with a phenol or alcohol.

Examples of the phosphate include trimethyl phosphate, triethyl phosphate, tributyl phosphate, trioctyl phosphate, tributoxyethyl phosphate, triphenyl phosphate, tricresyl phosphate, trixylenyl phosphate, cresyl diphenyl phosphate, diphenyl orthoxenyl phosphate, octyl diphenyl phosphate, phenyl isopropylphenyl phosphate, diphenyl isopropylphenyl phosphate, tris(isopropylphenyl) phosphate, tris (chloroethyl) phosphate and trisdichloropropyl phosphate.

Of these, especially preferred are tricresyl phosphate, phenyl isopropylphenyl phosphate, diphenyl isopropylphenyl phosphate and tris(isopropylphenyl) phosphate.

The proportion of the phosphate in the inventive composition is from 1.0 to less than 5.0%, by weight based on the amount of the polyol ester base oil.

According to JP-A-5-59388 (U.S. Pat. No. 5,342,533) which is cited above, phosphate proportions of less than 5.0% by weight result in insufficient wear resistance and insufficient inhibition of sludge formation. However, when a phosphate is added to a polyol ester base oil together with an alkyl or aryl phosphorothionate and an epoxy compound in optimum proportions in accordance with the present invention, the benefit of the phosphate can be fully realized even though its proportion is less than 5.0% by weight. If the proportion of the phosphate is below 1.0% by weight, the use thereof in combination with the alkyl or aryl phosphorothionate and the epoxy compound does not produce the desired effect, thereby resulting in insufficient wear resistance.

(2) Alkyl Phosphorothionate and Aryl Phosphorothionate

Examples of the alkyl phosphorothionate include trimethyl phosphorothionate, triethyl phosphorothionate, tributyl phosphorothionate, trioctyl phosphorothionate, tridecyl phosphorothionate and trilauryl phosphorothionate.

Examples of the aryl phosphorothionate include triphenyl phosphorothionate.

The alkyl phosphorothionate and the aryl phosphorothionate may be used either alone or as a mixture thereof.

The proportion of the alkyl phosphorothionate and/or aryl phosphorothionate in the inventive composition is from 0.1 to 2.0% by weight based on the amount of the polyol ester base oil. If the proportion thereof is below 0.1% by weight, wear resistance is not improved. A proportion thereof exceeding 2.0% by weight results not only in poor dissolution in refrigerants and in the polyol ester, but also the effect of the increased addition amount thereof is not appreciable.

(3) Epoxy Compound

Examples of the epoxy compound include phenyl glycidyl ether, alkylphenyl glycidyl ether, 1,2-epoxyalkane and vinylcyclohexene dioxide. These may be used either alone or as a mixture thereof. Of these, 1,2-epoxyalkane and vinylcyclohexene dioxide are preferred.

Examples of the alkylphenyl glycidyl ether include butylphenyl glycidyl ether, pentylphenyl glycidyl ether, hexylphenyl glycidyl ether, heptylphenyl glycidyl ether, octylphenyl glycidyl ether, nonylphenyl glycidyl ether and decylphenyl glycidyl ether.

Examples of the 1,2-epoxyalkane include 1,2-epoxyhexane, 1,2-epoxyheptane, 1,2-epoxyoctane, 1,2-epoxydecane, 1,2-epoxyhendecane, 1,2-epoxydodecane, 1,2-epoxytridecane, 1,2-epoxytetradecane, 1,2-epoxyhexadecane, 1,2-epoxyheptadecane and 1,2-epoxyoctadecane.

The 1,2-epoxyalkane can be obtained by the epoxidization reaction of α-olefine. It is represented by the following formula:

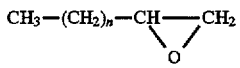

The vinylcyclohexene dioxide includes various isomers, and a typical example thereof has the following structural formula:

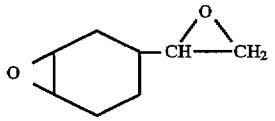

The proportion of the epoxy compound in the inventive composition is from 0.05 to 2.0% by weight based on the amount of the polyol ester base oil.

If the proportion of the epoxy compound is below 0.05% by weight, lubricity is not improved and the effect of inhibiting deterioration of the polyol ester is insufficient. A proportion thereof exceeding 2.0% by weight results in poor dissolution in refrigerants and in the polyol ester.

(4) Other Additives

Additives ordinarily used for refrigerating machine oils, e.g., an antioxidant, a metal deactivator and a defoaming agent, may be incorporated into the refrigerating machine oil composition of the present invention as long as the additives do not adversely influence the refrigerating machine oil performance of the present invention.

The antioxidant may be a hindered phenol compound, an amine compound, a sulfur compound, etc. Examples thereof include 2,6-di-t-butyl-4-methylphenol, 4,4'-methylenebis(2,6-di-t-butylphenol), 2,2'-thiobis(4-methyl-6-t-butylphenol), trimethyldihydroquinone, p,p'-dioctyldiphenylamine, 3,7-dioctylphenothiazine, alkyl phenothiazine-1-carboxylate, phenyl-2-naphthylamine, 2,6-di-t-butyl-2-dimethyl-p-cresol, 5-ethyl-10,10'-diphenylphenazarine and alkyl disulfide.

Examples of the metal deactivator include alizanin, quilizanin, benzotriazole and mercaptobenzotriazole.

Examples of the defoaming agent include dimethylpolysiloxane and metal salts of carboxylic acids.

The base oil used in the composition of the present invention is a polyol ester, which has good compatibility with either of HCFC refrigerants and HFC refrigerants and has satisfactory low-temperature fluidity and low hygroscopicity.

The naphthenic mineral oils, paraffinic mineral oils, alkylbenzenes, and poly-α-olefines for use with HCFC refrigerants cannot be used as the base oil of the refrigerating machine oil composition of the present invention, because they have poor compatibility with HFC refrigerants.

Polyol esters have drawbacks in that they generate a sludge when used with HCFC refrigerants, have insufficient lubricity, and tend to generate a sludge at high temperatures when used with HFC refrigerants.

These drawbacks of polyol esters have been eliminated in the composition of the present invention by adding a phosphate in an amount of from 1.0 to less than 5.0% by weight, along with an alkyl phosphorothionate and/or aryl phosphorothionate and an epoxy compound in optimum proportions to thereby produce a synergistic effect of these additives.

Each of the phosphate, the alkyl phosphorothionate and the aryl phosphorothionate is an extreme pressure additive, and a combination of the phosphate and the phosphorothionate improves lubricity when used with either of HCFC refrigerants and HFC refrigerants.

Specifically, the following have been found. When used with an HCFC refrigerant, the phosphate and the alkyl phosphorothionate and/or aryl phosphorothionate are adsorbed onto and react with sliding surfaces to yield iron phosphate and iron sulfide. On the other hand, chlorine atoms contained in the HCFC refrigerant react on the sliding surfaces to yield a chloride. Thus, the additives and the products by reaction produce a synergistic effect to achieve satisfactory wear resistance. Addition of the epoxy compound further improves the wear resistance.

When used with an HFC refrigerant, a small amount of the phosphate alone is insufficient to provide the effect of an extreme pressure additive because the refrigerant does not contain chlorine atoms. However, when the phosphate is used in combination with the alkyl phosphorothionate and/or aryl phosphorothionate, iron phosphate and iron sulfide form on sliding surfaces due to the synergistic effect of these additives to form a highly durable film having high lubricity. As a result, wear resistance and load carrying capacity last over long periods of operation.

The epoxy compound functions as a chlorine catcher, and a thermal and chemical stability improver. The epoxy compound effectively prevents sludge formation caused by deterioration of the polyol ester when used with either an HCFC refrigerant and an HFC refrigerant.

Specifically, when used with an HCFC refrigerant, the polyol ester is pyrolyzed and the deterioration thereof is accelerated by the action of chlorine atoms contained in the HCFC refrigerant. Because the epoxy compound promptly reacts with the generated chlorine, the epoxy compound inhibits deterioration of the polyol ester. Moreover, because the phosphate and the alkyl phosphorothionate and/or aryl phosphorothionate are thermally and chemically stable to the HCFC refrigerant, these additives do not exert any adverse influence.

When used with an HFC refrigerant, the epoxy compound inhibits sludge formation in high-temperature regions because it improves thermal and chemical stability.

The present invention will be explained in greater detail below by reference to following Examples and Comparative Examples. However, the present invention should not be construed as being limited to these Examples. The base oils, additives, and test methods used in the Examples and Comparative Examples and the results of the tests are as follows.

1. Base Oils (1) Examples 1 to 8 and Comparative Examples 1 to 12

A polyol ester was used as the base oil which had been synthesized by reacting pentaerythritol and a mixture of branched fatty acids having 7, 8, and 9 carbon atoms (2-methylhexanoic acid and 2-ethylpentanoic acid for the $C_7$-fatty acids; 2-ethylhexanoic acid for the $C_8$-fatty acid; and 3,5,5-trimethylhexanoic acid for the $C_9$-fatty acid), respectively. The polyol ester had an acid value of 0.01 mgKOH/g or lower and a water content of 100 ppm or lower.

(2) Comparative Example 13

Alkylbenzene ABA-H (hard type alkylbenzene manufactured by Mitsubishi Chemical Ltd., Japan) was used as the base oil.

This alkylbenzene is ordinarily used as the base oil of refrigerating machine oils for use in refrigerating machines employing HCFC-22 refrigerant.

2. Additives

Tricresyl phosphate was used as the phosphate.

Triphenyl phosphorothionate was used as the aryl phosphorothionate, and trioctyl phosphorothionate was used as the alkyl phosphorothionate.

Vinylcyclohexene dioxide was used as the epoxy compound.

The addition amounts of these additives based on the amount of the base oil are shown in Tables 1 to 4.

The refrigerating machine oil of Comparative Example 13, in which the alkylbenzene was used as the base oil, contained no additives.

3. Test Methods (1) Wearing Test

A wearing test was performed with a Falex tester (ASTM D2714) using a steel ring and steel blocks as test materials in atmospheres of HFC-134a refrigerant and HCFC-22 refrigerant. The wear volume of the steel block surface was measured after the test. The test conditions included a temperature of 100° C., a test period of 1 hour, and an atmospheric-gas pressure of 600 kPa.

The test results obtained are shown as relative ratio, with the wear volume in Comparative Example 13 (refrigerant, HCFC-22; base oil, alkylbenzene) as a reference taken as 1.0.

(2) Thermal and Chemical Stability Test

A sealed tube test was conducted in atmospheres of HFC-134a refrigerant and HCFC-22 refrigerant.

The sealed tube test is ordinarily employed for examining the thermal and chemical stability of a refrigerating machine oil. In this test, 1 ml of a refrigerant, 1 ml of an oil sample, and Fe, Cu, and Al wires each having a diameter of 1.6 mm and a length of 30 mm are placed in a glass tube, and the glass tube is sealed and heated to examine the oil sample for a color change, i.e., for sludge formation. The test conditions included a temperature of 175° C. and a test period of 14 days.

After completion of the test, the sample oil was evaluated based on the resulting color change. Samples which exhibited no color change are indicated by o, samples which exhibited a considerable color change are indicated by x, and samples which exhibited a slight color change are indicated by Δ.

4. Test Results

The results of the wearing test and the thermal and chemical stability test both performed in an atmosphere of HFC-134a refrigerant are shown in Tables 1 and 2.

TABLE 1

| Results of tests in HFC-134a refrigerant atmosphere | Example | | | | | | | | Comparative Example | | | |
|---|---|---|---|---|---|---|---|---|---|---|---|---|
| | 1 | 2 | 3 | 4 | 5 | 6 | 7 | 8 | 1 | 2 | 3 | 4 |
| Composition | | | | | | | | | | | | |
| Base Oil | polyol ester | | | | | | | | polyol ester | | | |
| Additives (wt %) | | | | | | | | | | | | |
| Phosphate | 1.0 | 1.0 | 4.9 | 1.0 | 1.0 | 1.0 | 1.0 | 4.9 | — | 1.0 | — | — |
| Aryl phosphorothionate | 0.5 | — | 0.5 | 0.1 | 2.0 | 0.5 | 0.5 | 2.0 | — | — | 0.5 | — |
| Alkyl phosphorothionate | — | 0.5 | — | — | — | — | — | — | — | — | — | — |
| Epoxy compound | 0.5 | 0.5 | 0.5 | 0.5 | 0.5 | 0.05 | 2.0 | 0.5 | — | — | — | 0.5 |
| Test Results | | | | | | | | | | | | |
| Wearing test (wear volume ratio) | 0.9 | 0.9 | 0.9 | 0.9 | 0.9 | 0.9 | 0.9 | 0.6 | 4.0 | 2.5 | 3.5 | 4.0 |
| Thermal and chemical stability test | | | | | | | | | | | | |
| Fe | o | o | o | o | o | o | o | o | o | o | Δ | o |
| Cu | o | o | o | o | o | o | o | o | o | o | o | o |
| Al | o | o | o | o | o | o | o | o | o | o | o | o |

TABLE 2

| Results of tests in HFC-134a refrigerant atmosphere | Comparative Example | | | | | | | | |
|---|---|---|---|---|---|---|---|---|---|
| | 5 | 6 | 7 | 8 | 9 | 10 | 11 | 12 | 13 |
| Composition | | | | | | | | | |
| Base Oil | polyol ester | | | | | | | | alkylbenzene |
| Additives (wt %) | | | | | | | | | |
| Phosphate | — | 1.0 | 1.0 | 1.0 | 4.9 | 0.5 | 1.0 | 1.0 | — |
| Aryl phosphorothionate | 0.5 | — | 0.5 | 2.0 | 2.0 | 0.5 | 0.05 | 3.0 | — |
| Epoxy compound | 0.5 | 0.5 | — | — | — | 0.5 | 0.5 | 0.5 | — |
| Test Results | | | | | | | | | |
| Wearing test (wear volume ratio) | 4.0 | 4.0 | 0.9 | 0.9 | 0.6 | 2.0 | 2.0 | 0.9 | 1.0 |
| Thermal and chemical stability | | | | | | | | | |

TABLE 2-continued

| Results of tests in HFC-134a refrigerant atmosphere | Comparative Example | | | | | | | | |
|---|---|---|---|---|---|---|---|---|---|
| | 5 | 6 | 7 | 8 | 9 | 10 | 11 | 12 | 13 |
| test | | | | | | | | | |
| Fe | o | o | Δ | Δ | Δ | o | o | Δ | o |
| Cu | o | o | o | o | o | o | o | o | o |
| Al | o | o | o | o | o | o | o | o | o |

Note: The refrigerant in Comparative Example 13 was HCFC-22.

The results of the wearing test and the thermal and chemical stability test which were both performed in an atmosphere of HCFC-22 refrigerant are shown in Tables 3 and 4.

TABLE 3

| Results of tests in HCFC-22 refrigerant atmosphere | Example | | | | | | | | Comparative Example | | | |
|---|---|---|---|---|---|---|---|---|---|---|---|---|
| | 1 | 2 | 3 | 4 | 5 | 6 | 7 | 8 | 1 | 2 | 3 | 4 |
| Composition | | | | | | | | | | | | |
| Base Oil | polyol ester | | | | | | | | polyol ester | | | |
| Additives (wt %) | | | | | | | | | | | | |
| Phosphate | 1.0 | 1.0 | 4.9 | 1.0 | 1.0 | 1.0 | 1.0 | 4.9 | — | 1.0 | — | — |
| Aryl phosphorothionate | 0.5 | — | 0.5 | 0.1 | 2.0 | 0.5 | 0.5 | 2.0 | — | — | 0.5 | — |
| Alkyl phosphorothionate | — | 0.5 | — | — | — | — | — | — | — | — | — | — |
| Epoxy compound | 0.5 | 0.5 | 0.5 | 0.5 | 0.5 | 0.05 | 2.0 | 0.5 | — | — | — | 0.5 |
| Test Results | | | | | | | | | | | | |
| Wearing test (wear volume ratio) | 0.6 | 0.6 | 0.6 | 0.9 | 0.5 | 0.5 | 0.5 | 0.4 | 1.5 | 1.5 | 1.5 | 1.5 |
| Thermal and chemical stability test | | | | | | | | | | | | |
| Fe | o | o | o | o | o | o | o | o | o | o | Δ | o |
| Cu | o | o | o | o | o | o | o | o | o | o | o | o |
| Al | o | o | o | o | o | o | o | o | o | o | o | o |

TABLE 4

Results of tests in HCFC-22 refrigerant atmosphere

| | Comparative Example | | | | | | | | |
|---|---|---|---|---|---|---|---|---|---|
| | 5 | 6 | 7 | 8 | 9 | 10 | 11 | 12 | 13 |
| Composition | | | | | | | | | |
| Base Oil | polyol ester | | | | | | | | alkylbenzene |
| Additives (wt %) | | | | | | | | | |
| Phosphate | — | 1.0 | 1.0 | 1.0 | 4.9 | 0.5 | 1.0 | 1.0 | — |
| Aryl phosphorothionate | 0.5 | — | 0.5 | 2.0 | 2.0 | 0.5 | 0.05 | 3.0 | — |
| Epoxy compound | 0.5 | 0.5 | — | — | — | 0.5 | 0.5 | 0.5 | — |
| Test Results | | | | | | | | | |
| Wearing test (wear volume ratio) | 1.5 | 1.3 | 1.0 | 1.0 | 0.6 | 1.5 | 1.5 | 0.6 | 1.0 |
| Thermal and chemical stability test | | | | | | | | | |
| Fe | ○ | ○ | Δ | x | x | ○ | ○ | Δ | ○ |
| Cu | ○ | ○ | ○ | Δ | Δ | ○ | ○ | ○ | ○ |
| Al | ○ | ○ | ○ | ○ | ○ | ○ | ○ | ○ | ○ |

(1) Examples 1 to 8 and Comparative Example 13

The machine oil compositions of the Examples of the invention each exhibited better wear resistance than the oil of Comparative Example 13 (prior art composition) when HCFC-22 refrigerant was used. The Examples of the invention also exhibited satisfactory thermal and chemical stability and were free from sludge formation.

The above results show that the machine oil compositions of the Examples are suitable for use with either of an HFC-134a refrigerant and an HCFC-22 refrigerant. The results further show that even when the addition amount of the phosphate is less than 5.0% by weight, satisfactory wear resistance and high thermal and chemical stability are attained when the alkyl or aryl phosphorothionate and the epoxy compound are also added in accordance with the present invention.

(2) Comparative Examples 2 to 9

The machine oil compositions of Comparative Examples 2 to 4, each consisting of the polyol ester and only one additive, all were inferior in wear resistance as compared to the compositions of Examples 1 to 8 and the oil of Comparative Example 13.

The machine oil composition of Comparative Example 5 (containing a combination of the aryl phosphorothionate and the epoxy compound) and the machine oil composition of Comparative Example 6 (containing a combination of the phosphate and the epoxy compound) were both inferior in wear resistance as compared to the compositions of Examples 1 to 8 and the oil of Comparative Example 13.

The machine oil compositions of Comparative Examples 7 to 9 (containing a combination of the phosphate and the aryl phosphorothionate) each exhibited poor thermal and chemical stability and generated a sludge.

The above results show that use of the phosphate, the aryl or alkyl phosphorothionate and the epoxy compound in combination is essential for attaining the object of the invention and for providing the above described performance characteristics.

A comparison between Example 3 and Example 8 in Table 1, a comparison between Examples 1, 2 and 5 and Example 4 in Table 3, a comparison between Example 3 and Example 8 in Table 3, and a comparison between Comparative Example 2 and Comparative Examples 7 and 8 in Tables 1 to 4 show that the aryl or alkyl phosphorothionate, when used in combination with the phosphate, effectively improves wear resistance.

Furthermore, a comparison between Examples 1 and 2 and Comparative Example 7 in Tables 3 and 4 and a comparison between Example 5 and Comparative Example 8 in Tables 3 and 4 shows that addition of the epoxy compound effectively further improves wear resistance.

(3) Comparative Example 10

The machine oil composition of Comparative Example 10 (containing 0.5 wt % phosphate) was inferior in wear resistance as compared to the compositions of Examples 1 to 3 and the oil of Comparative Example 13.

The above results show that the lower limit of the addition amount of the phosphate in the inventive composition is 1.0% by weight based on the amount of the polyol ester base oil.

(4) Comparative Examples 11 and 12

The machine oil composition of Comparative Example 11 (containing 0.05 wt % aryl phosphorothionate) was inferior in wear resistance as compared to the compositions of Examples 4 and 5 and the oil of Comparative Example 13. The machine oil composition of Comparative Example 12 (containing 3.0 wt % aryl phosphorothionate) was inferior in thermal and chemical stability as compared to the compositions of Examples 4 and 5 and the oil of Comparative Example 13.

The above results show that the proportion of the aryl phosphorothionate in the composition should be in the range of from 0.1 to 2.0% by weight based on the amount of the polyol ester base oil.

(5) Comparative Examples 7 to 9

The machine oil compositions of Comparative Examples 7 to 9, containing no epoxy compound, were all inferior in thermal and chemical stability as compared to the compositions of Examples 6 and 7 and the oil of Comparative Example 13.

A test was conducted which shows that the epoxy compound, when added in an amount exceeding 2.0% by weight, shows poor dissolution in refrigerants and in the polyol ester.

In view of the above, the proportion of the epoxy compound in the composition is in the range of from 0.05 to 2.0% by weight based on the amount of the polyol ester base oil.

In a separate experiment, machine oil compositions were prepared having the same compositions of Examples 1 and 3 to 8, respectively, except that a mixture of triphenyl phosphorothionate and trioctyl phosphorothionate was used in place of triphenyl phosphorothionate. These compositions were subjected to the wearing test and thermal and chemical stability test described above. As a result, the same effects as in Examples 1 and 3 to 8 were obtained.

In this connection, the following should be noted. Dibenzyl disulfide and sulfurized fats or oils are sometimes used as sulfur compound additives in which the alkyl or aryl phosphorothionate are grouped. However, use of dibenzyl disulfide is ineffective in improving wear resistance and generates a large amount of sludge. Use of sulfurized fats or oils results in the generation of a large amount of a sludge. Thus, benzyl disulfide and sulfurized fats or oils are more active than the alkyl phosphorothionate and aryl phosphorothionate, and hence cannot be used in place of these phosphorothionates.

5. Methods and Results of Other Tests (1) Friction Torque Test

Using the apparatus illustrated in FIG. 1, each of sample oils (Example 1 and Comparative Examples 1 and 2) was circulated and the friction torque thereof was measured with a four-ball tester at intervals of certain time periods in an atmosphere of HFC-134a refrigerant. In FIG. 1, numeral 1 denotes the four-ball tester, 2 is a refrigerant bomb, 3 is a sample oil tank, 4 is a pump for sample oil circulation, and 5 is a flowmeter.

Figure 2:
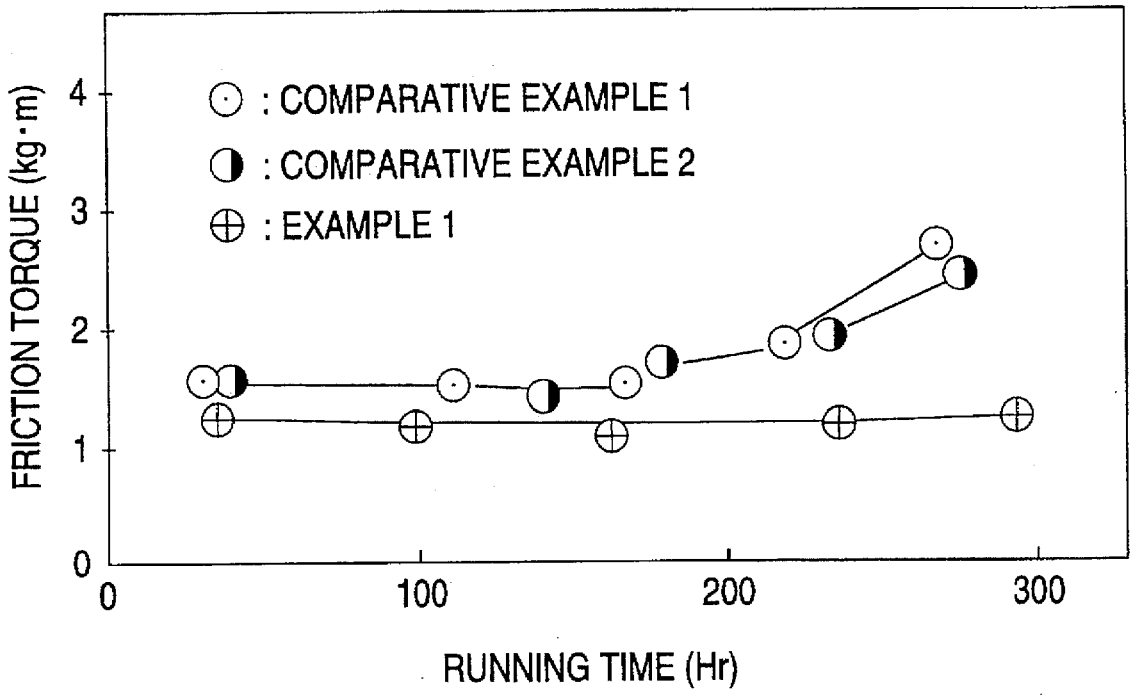
FIG. 2 is a graph showing the results of a friction torque test in which the apparatus shown in FIG. 1 was used in an atmosphere of HFC-134a refrigerant.

The results obtained are shown in FIG. 2.

The machine oil composition of Example 1 was found to exhibit little friction torque change during the long-term run, and had a longer life as compared to the oil of Comparative Example 1 (consisting of the polyol ester as a base oil and containing no additives) and the composition of Comparative Example 2 (consisting of the polyol ester as a base oil and the phosphate as the only additive).

With respect to the composition of Example 1, the friction torque measurement was also made in an atmosphere of HCFC-22 refrigerant.

Figure 3:
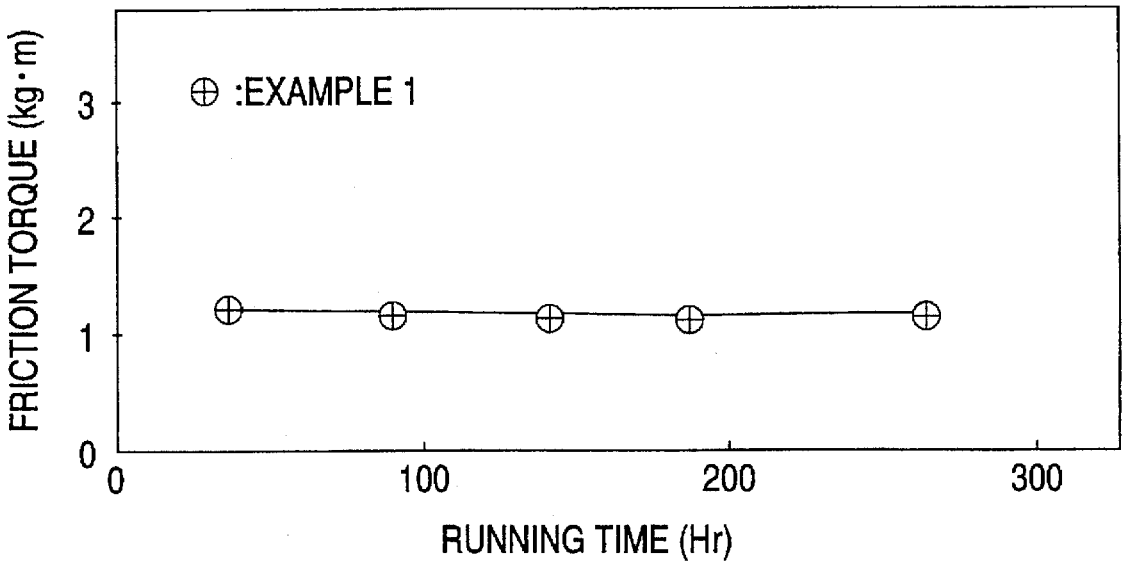
FIG. 3 is a graph showing the results of a friction torque test in which the apparatus shown in FIG. 1 was used in an atmosphere of HCFC-22 refrigerant.

The results obtained are shown in FIG. 3.

The machine oil composition of Example 1 also had a long life in an HCFC-22 refrigerant atmosphere as well as in an atmosphere of HFC-134a refrigerant.

(2) Accelerated Compressor Durability Test

The composition of Example 1 and the oil of Comparative Example 13 (consisting of the alkylbenzene as a base oil and containing no additives) were subjected to an accelerated compressor durability test using a compressor for practical use.

Figure 4:
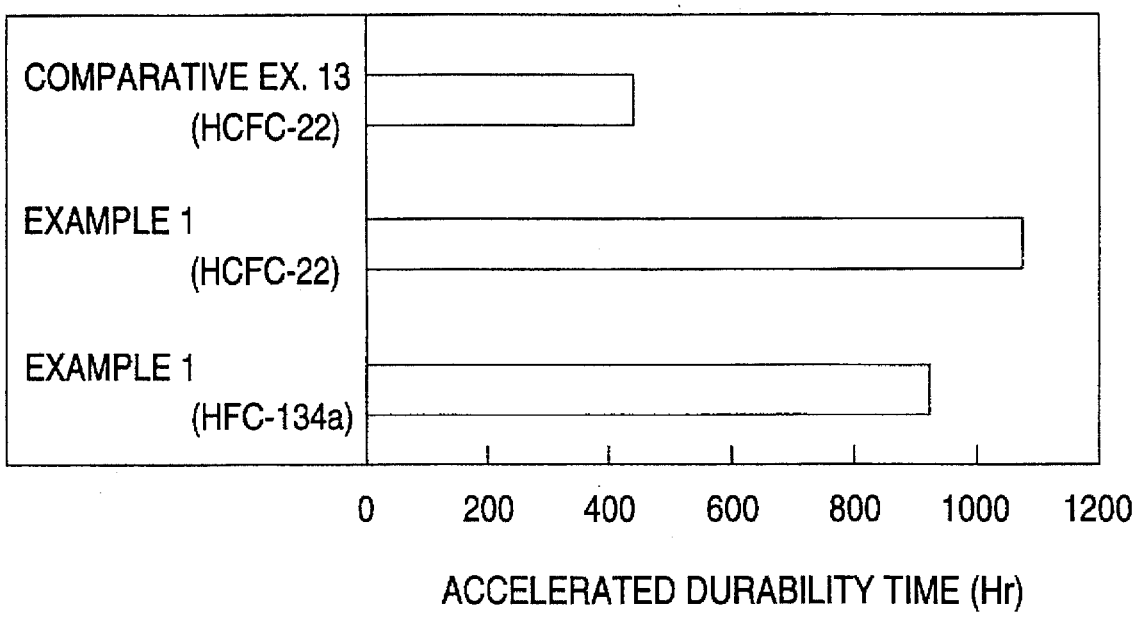
FIG. 4 is a graph showing the results of an accelerated compressor durability test.

The results obtained are shown in FIG. 4.

The machine oil composition of Example 1 was found to be superior in durability and deterioration resistance as compared to the oil of Comparative Example 13 used as a reference for performance evaluations when used with either of HCFC-22 and HFC-134a refrigerants.

The accelerated durability time for the oil of Comparative Example 13 can be used as a standard in performance evaluations to determine an index to the life of a compressor under ordinary use conditions.

The refrigerating machine oil composition for vapor compressors of the present invention is suitable for use with either of the currently used HCFC refrigerants and the HFC refrigerants which are being investigated as new refrigerants.

A characteristic feature of the composition of the present invention is that even though the proportion of a phosphate added to the polyol ester base oil is less than 5.0% by weight based on the base oil, sludge formation is inhibited and lubricity is improved due to the synergistic effect produced by further adding an alkyl phosphorothionate and/or an aryl phosphorothionate and an epoxy compound in addition to the phosphate in optimum proportions.

The refrigerating machine oil composition of the present invention has excellent compatibility with refrigerants and excellent electrical insulating properties, and also has low hygroscopicity due to the use of a polyol ester (ester type synthetic oil) as a base oil.

Furthermore, the refrigerating machine oil composition of the present invention consists essentially of a polyol ester as a base oil and a phosphate and an alkyl phosphorothionate and/or an aryl phosphorothionate as extreme pressure additives and an epoxy compound as both a chlorine catcher and a thermal and chemical stability enhancer in optimum proportions.

Consequently, the refrigerating machine oil composition of the present invention is free from sludge formation and insufficient lubricity, which are drawbacks of the polyol ester. This is due to the synergistic effect of the three kinds of additives. On the other hand, the inventive composition provides the desirable properties of a polyol ester base oil, namely, good compatibility with refrigerants, high electrical insulating properties and low hygroscopicity.

While the invention has been described in detail and with reference to specific embodiments thereof, it will be apparent to one skilled in the art that various changes and modifications can be made therein without departing from the spirit and scope thereof.

What is claimed is:

1. A refrigerating machine oil composition for use in a vapor compressor employing a hydrochlorofluorocarbon or a hydrofluorocarbon as a refrigerant which comprises at least one polyol ester selected from the group consisting of a carboxylate of pentaerythritol and a carboxylate of dipentaerythritol as a base oil, said base oil containing (a) at least one phosphate selected from the group consisting of trimethyl phosphate, triethyl phosphate, tributyl phosphate, trioctyl phosphate, tributoxyethyl phosphate, triphenyl phosphate, tricresyl phosphate, trixylenyl phosphate, cresyl diphenyl phosphate, diphenyl orthoxenyl phosphate, octyl diphenyl phosphate, phenyl isopropylphenyl phosphate, diphenyl isopropylphenyl phosphate, tris (isopropylphenyl) phosphate, tris(chloroethyl) phosphate and trisdichloropropyl phosphate in an amount of from 1.0 to less than 5.0% by weight, (b) at least one compound selected from the group consisting of an alkyl phosphorothionate and an aryl phosphorothionate in an amount of from 0.1 to 2.0% by weight, and (c) a vinylcyclohexene dioxide in an amount of from 0.05 to 2.0% by weight, wherein the amounts of ingredients (a), (b) and (c) each is based on the amount of said base oil.

2. The refrigerating machine oil composition of claim 1, wherein said polyol ester base oil has a viscosity of from 5 to 150 $mm^2/s$ at 40° C., an acid value of up to 1 mgKOH/g and a water content of up to 500 ppm.

3. The refrigerating machine oil composition of claim 1, wherein said polyol ester base oil has an acid value of 0.01 mgKOH/g or lower and a water content of 100 ppm or lower.

4. The refrigerating machine oil composition of claim 1, wherein said phosphate is selected from the group consisting of tricresyl phosphate, phenyl isopropylphenyl phosphate, diphenyl isopropylphenyl phosphate and tris (isopropylphenyl) phosphate.

5. The refrigerating machine oil composition of claim 1 wherein the phosphate is tricresyl phosphate.

* * * * *